US012607001B2

(12) United States Patent
Fang

(10) Patent No.: US 12,607,001 B2
(45) Date of Patent: Apr. 21, 2026

(54) TOILET COVER BASE, TOILET COVER ASSEMBLY, AND TOILET

(71) Applicant: Shanghai Kohler Electronics, Ltd., Shanghai (CN)

(72) Inventor: Yiguo Fang, Shanghai (CN)

(73) Assignee: Shanghai KOHLER Electronics, Ltd., Shanghai (CN)

( * ) Notice: Subject to any disclaimer, the term of this patent is extended or adjusted under 35 U.S.C. 154(b) by 260 days.

(21) Appl. No.: 18/215,069

(22) Filed: Jun. 27, 2023

(65) Prior Publication Data

US 2024/0011271 A1 Jan. 11, 2024

(30) Foreign Application Priority Data

Jul. 5, 2022 (CN) ..... 202221717087.0

(51) Int. Cl.
*E03D 9/08* (2006.01)
*A47K 13/26* (2006.01)

(52) U.S. Cl.
CPC ..... *E03D 9/08* (2013.01); *A47K 13/26* (2013.01)

(58) Field of Classification Search
CPC ..... E03D 9/08; A47K 13/26
See application file for complete search history.

(56) References Cited

U.S. PATENT DOCUMENTS

| | | | | |
|---|---|---|---|---|
| 2018/0058057 | A1* | 3/2018 | Kawada | A47K 13/30 |
| 2021/0017751 | A1* | 1/2021 | Morikawa | E03D 9/002 |
| 2021/0017753 | A1* | 1/2021 | Sylvia | E03D 9/085 |
| 2022/0154441 | A1* | 5/2022 | Song | A47K 10/48 |

* cited by examiner

*Primary Examiner* — Christine J Skubinna
(74) *Attorney, Agent, or Firm* — Lempia Summerfield Katz LLC

(57) ABSTRACT

A toilet cover base includes a base body; a base side plate connected to a side of the base body; a pipeline arrangement groove disposed in the base body and configured to accommodate at least one pipeline; a pipeline through groove disposed in the base side plate and configured to allow the at least one pipeline to pass through; and a trim cover removably installed in the pipeline through groove.

17 Claims, 7 Drawing Sheets

TOILET COVER BASE, TOILET COVER ASSEMBLY, AND TOILET

CROSS REFERENCE TO RELATED APPLICATION

This application claims the benefit of priority to: Chinese Patent Application No. 202221717087.0 filed in the Chinese Intellectual Property Office on Jul. 5, 2022, which is hereby incorporated by reference in its entirety.

FIELD

The present disclosure relates to the technical field of bathroom toilet and particularly to a toilet cover base, a toilet cover assembly, and a toilet.

BACKGROUND

Smart toilets have a nozzle installed in a seat for user to clean the private part. For this purpose, it is necessary to install a water line in a toilet base to supply water.

There are two types of pipeline arrangement in the toilet base.

In the first arrangement, a pipeline through groove is arranged on a side of the toilet base, for a water supply hose and a power cord to pass through. This type of pipeline arrangement is a non-concealed arrangement, and the user can see the water supply hose and the power cord from the outside of the toilet.

In the second arrangement, no pipeline through groove is provided on the side of the toilet bowl base. Instead, a pipeline arrangement groove is provided in a bottom of the toilet base to arrange the water supply hose and the power cord through a ceramic body. This type of pipeline arrangement is a concealed arrangement, and the user cannot see the water supply hose and power cord from the outside of the toilet.

The toilet base cannot be used for both of these pipeline arrangements.

In view of this, it is necessary to provide a toilet cover base, a toilet cover assembly and a toilet that can meet the demands of both concealed and non-concealed pipeline arrangements.

SUMMARY

The present disclosure aims to overcome the defects and provide a toilet cover base, a toilet cover assembly, and a toilet that can meet the demands of both concealed and non-concealed pipeline arrangements.

According to an embodiment of the present disclosure, a toilet cover base comprises a base body and a base side plate connected to a side of the base body.

A pipeline arrangement groove is provided in a bottom of the base body.

A pipeline through groove is provided in the base side plate.

A trim cover is removably installed in the pipeline through groove.

In another embodiment of the present disclosure, the trim cover comprises an outer cover plate, an inner cover plate, and a cover connection plate connected between the outer cover plate and the inner cover plate.

A limit groove is provided at a groove opening of the pipeline through groove.

The outer cover plate is disposed in the limit groove, the base side plate is disposed between the outer cover plate and the inner cover plate, and the cover connection plate is connected to the base side plate by a connecting member.

In another embodiment of the present disclosure, a side plate boss is provided on one side of the base side plate, and the side plate boss is disposed around or adjacent to the pipeline through groove.

The inner cover plate is lapped over (e.g., abuts, contacts) the side plate boss.

In another embodiment of the present disclosure, the pipeline through groove is a U-shaped groove with a downward opening, and a top portion of the pipeline through groove has a connection hole.

The cover connection plate is a U-shaped plate with a downward opening, and a top portion of the cover connection plate has a connection plate through hole.

The cover connection plate is disposed in the pipeline through groove, and the connecting member passes through the connection plate through hole and is connected to the connection hole.

In another embodiment of the present disclosure, a top portion of the pipeline through groove has a side plate mounting plate extending towards a side of the base body, and the connection hole is provided in the side plate mounting plate.

A top portion of the cover connection plate has a connection plate protrusion protruding towards the side of the base body, and the connection plate through hole is provided in the connection plate protrusion.

In another embodiment of the present disclosure, the inner cover plate has a cover plate groove on the side that faces the connecting plate protrusion, and the connecting plate protrusion is connected in the cover plate groove.

In another embodiment of the present disclosure, the outer cover plate, the inner cover plate, and the cover connection plate are formed integrally.

In another embodiment of the present disclosure, an outer surface of the outer cover plate is flush (e.g., aligned) with an outer surface of the base side plate.

According to another embodiment of the present disclosure, a toilet cover assembly comprises the toilet cover base according to any one of the above embodiments.

According to another embodiment of the present disclosure, a toilet comprises the toilet cover assembly according to above embodiments.

By adopting the technical solutions above, the present disclosure has the following beneficial effects:

The present disclosure provides a toilet cover base, a toilet cover assembly, and a toilet, which can meet the non-concealed pipeline arrangement demand by removing the trim cover and can meet the concealed pipeline arrangement demand by installing the trim cover. Thus, the user's pipeline arrangement demands may be met, and the scope of present disclosure of the toilet product may be expanded.

BRIEF DESCRIPTION OF THE FIGURES

With reference to the drawings, the contents disclosed by the present disclosure should be more easily understood. It should be understood that these drawings are merely used for illustration and are not intended to limit the protection scope of the present disclosure. In the drawings.

DETAILED DESCRIPTION

Figure 1:
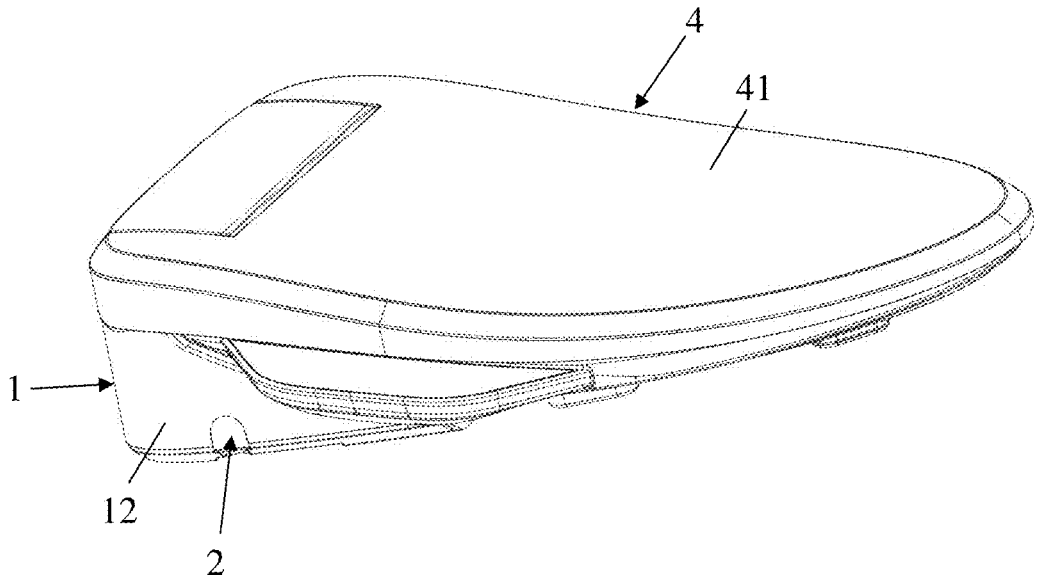
FIG. 1 shows a schematic diagram of a toilet cover base with a trim cover installed in a pipeline through groove according to an example of the present disclosure.

The specific embodiments of the present disclosure are further described with reference to the drawings hereinafter. Same or equivalent parts are denoted by same reference numerals. It should be noted that the terms "front", "back", "left", "right", "up" and "down" used in the following description refer to the directions in the drawings, and the terms "inner" and "outer" refer to the directions towards or far away from geometric centers of specific parts respectively.

Figure 2:
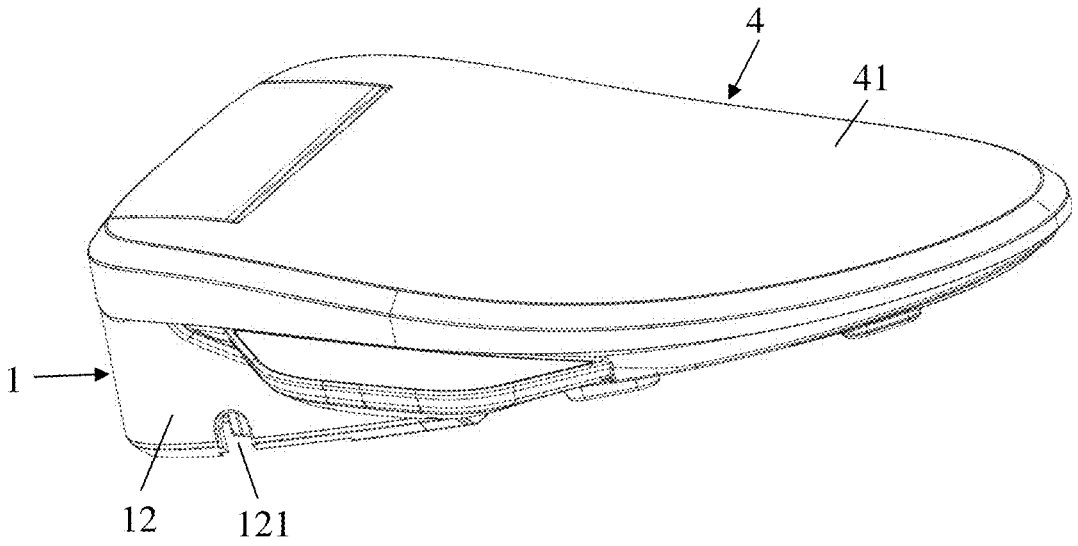
FIG. 2 shows a schematic diagram of the toilet cover base with the trim cover removed from the pipeline through groove according to an example of the present disclosure.
Figure 3:
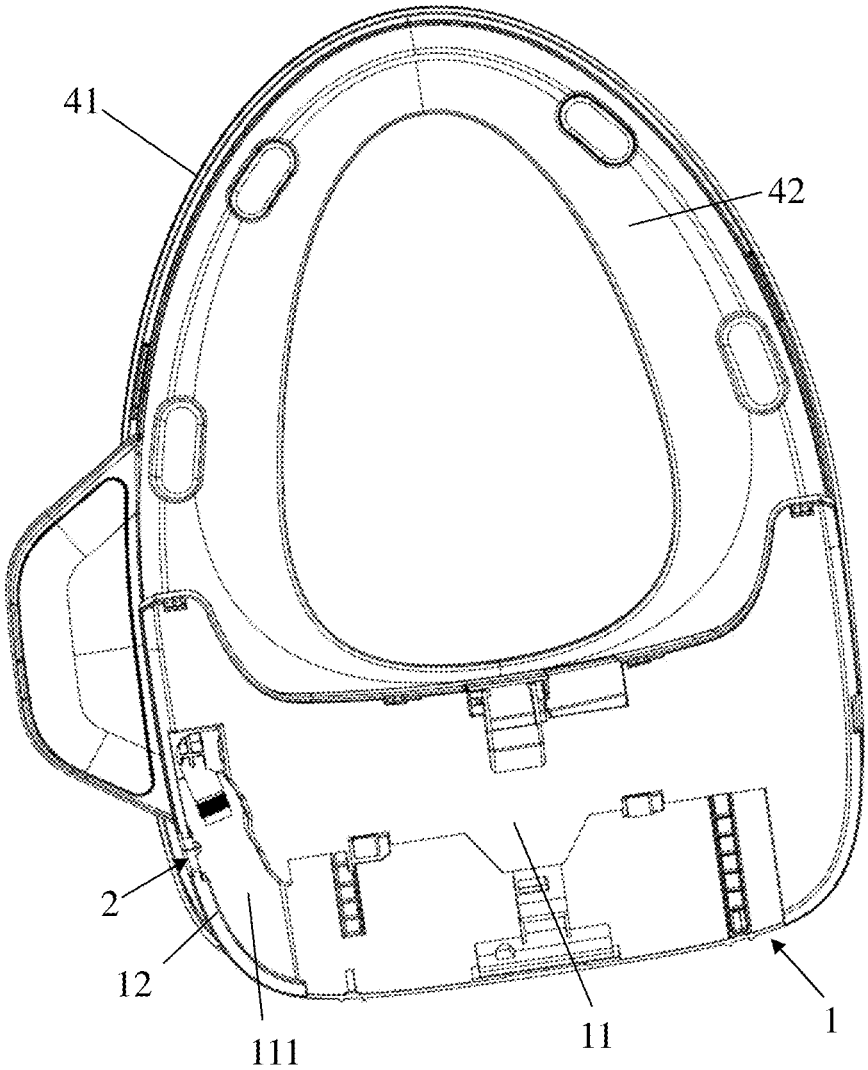
FIG. 3 shows a schematic diagram of the toilet cover base with a pipeline arrangement groove at the bottom of the base body according to an example of the present disclosure.
Figure 9:
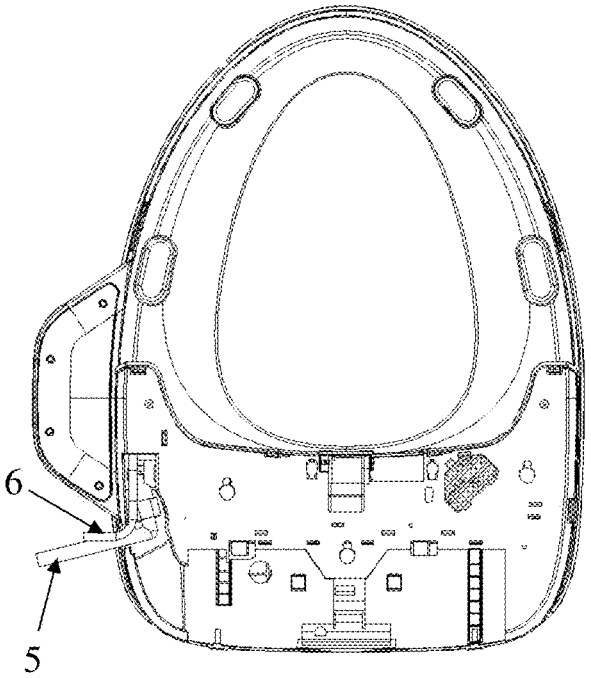
FIG. 9 shows a schematic view of the toilet cover base adopting a non-concealed pipeline arrangement.
Figure 10:
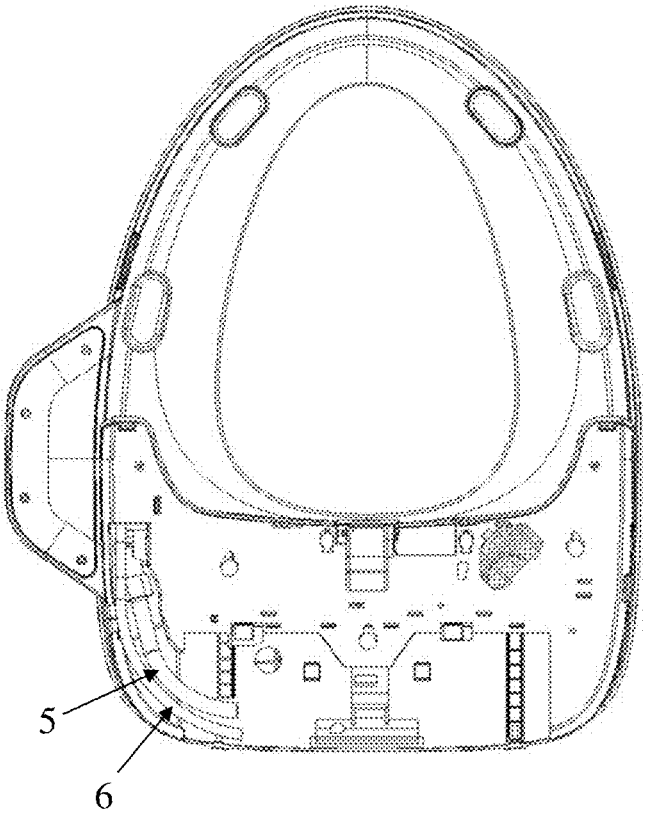
FIG. 10 shows a schematic view of the toilet cover base adopting a concealed pipeline arrangement.

FIG. 1 shows a schematic diagram of a toilet cover base with a trim cover installed in a pipeline through groove according to an example of the present disclosure. FIG. 2 shows a schematic diagram of the toilet cover base with the trim cover removed from the pipeline through groove according to an example of the present disclosure. FIG. 3 shows a schematic diagram of the toilet cover base with a pipeline arrangement groove at the bottom of the base body according to an example of the present disclosure. FIG. 9 shows a schematic view of the toilet cover base adopting a non-concealed pipeline arrangement. FIG. 10 shows a schematic view of the toilet cover base adopting a concealed pipeline arrangement. As shown in FIG. 1, FIG. 2, FIG. 3, FIG. 9, and FIG. 10, the toilet cover base 1 according to an embodiment of the present disclosure comprises a base body 11 and a base side plate 12 connected to a side of the base body 11.

A pipeline arrangement groove 111 is provided in a bottom of the base body 11.

A pipeline through groove 121 is provided in the base side plate 12.

A trim cover 2 is removably installed in the pipeline through groove 121.

The present disclosure provides a toilet cover base 1 as a part of a smart toilet. The toilet cover base 1 is used to install at a back end of a ceramic body of the smart toilet. A toilet cover 4 of the smart toilet is pivotally mounted on the toilet cover base 1. The toilet cover 4 comprises a seat cover 41 and a seat 42 below the seat cover 41.

The toilet cover base 1 comprises the base body 11 and the base side plate 12. The base side plate 12 is connected to the side of the base body 11 and extends downwards. The base side plate 12 may be formed integrally with the base body 11. One side of the base body 11 has a pipeline arrangement groove 111 configured to arrange or accommodate at least one pipeline, e.g., a water supply hose 5 and a power cord 6, to achieve a concealed pipeline arrangement. The base side plate 12 has a pipeline through groove 121 adjacent to the side of the pipeline arrangement groove 111. The pipeline through groove 121 is configured to allow the water supply hose 5 and the power cord 6 to pass through, in order to achieve a non-concealed pipeline arrangement.

The trim cover 2 is installed in the pipeline through groove 121, and the trim cover 2 is removably connected to the base side plate 12. The trim cover 2 can be connected to the base side plate 12 by a connecting member or by a snap-fit structure.

When the user adopts the non-concealed pipeline arrangement, the trim cover 2 is removed and the water supply hose 5, and the power cord 6 inwardly pass through the pipeline through groove 121 from the outer side of the base side plate 12.

When the user adopts the concealed pipeline arrangement, the trim cover 2 is mounted to the pipeline through groove 121, and the water supply hose 5 and power cord 6 pass through a rear portion of the ceramic body and then are arranged in the pipeline arrangement groove 111.

Thus, the present disclosure provides a toilet cover base that can meet the non-concealed pipeline arrangement demand by removing the trim cover 2 and the concealed pipeline arrangement demand by installing the trim cover 2. Thus, different pipeline arrangement demands of the user may be met, and the scope of present disclosure of the toilet product may be expanded.

Figure 4:
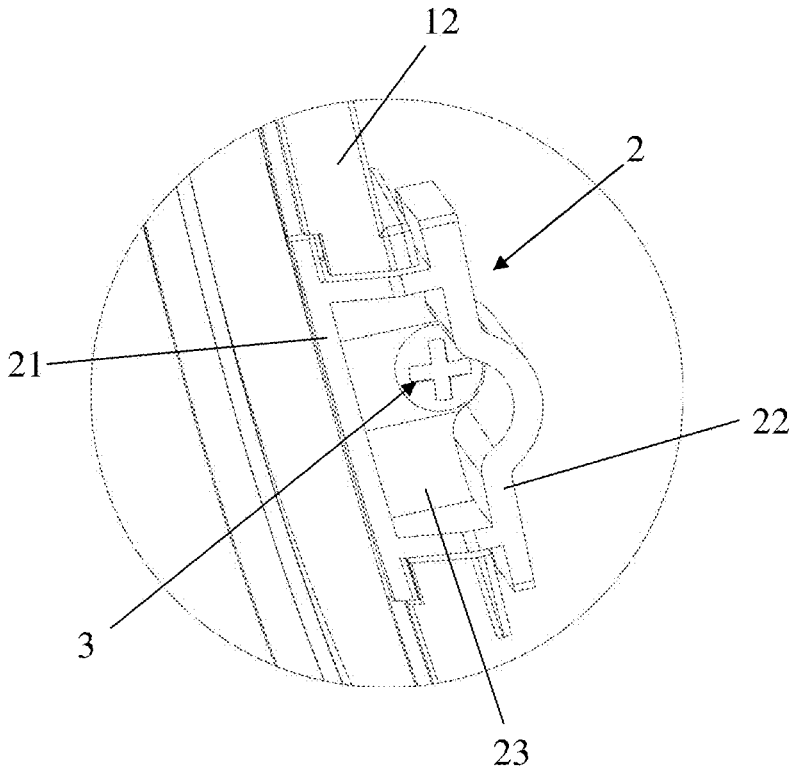
FIG. 4 shows an enlarged view of the trim cover installed in the pipeline through groove.
Figure 5:
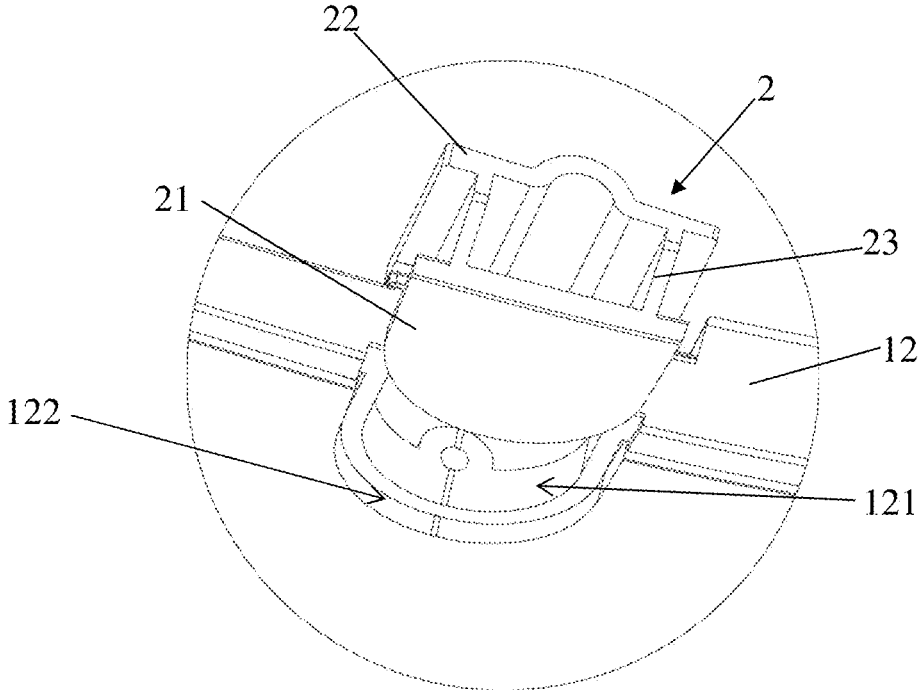
FIG. 5 shows a schematic view of the trim cover when inserted into the pipeline through groove.
Figure 6:
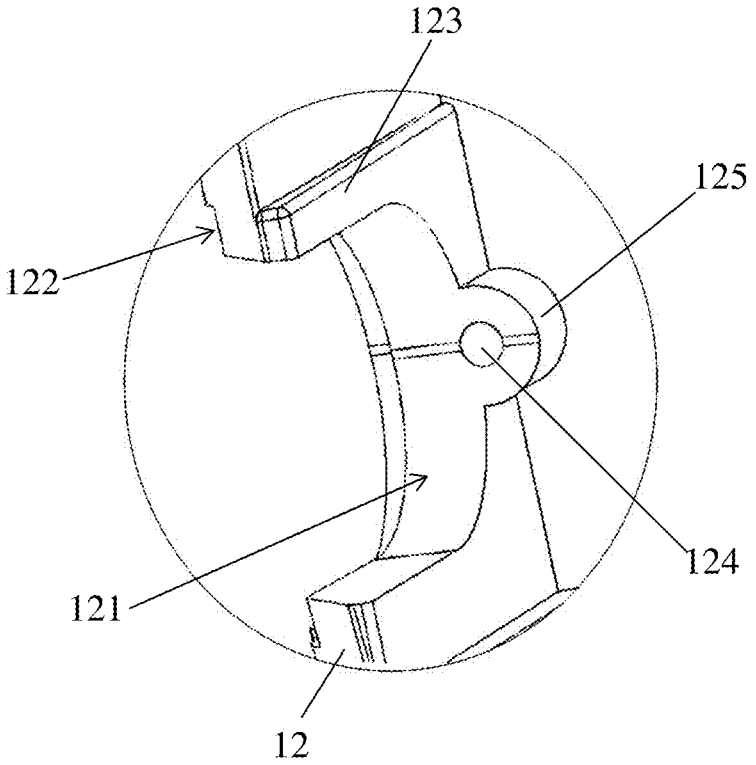
FIG. 6 shows a perspective view of the pipeline through groove.
Figure 7:
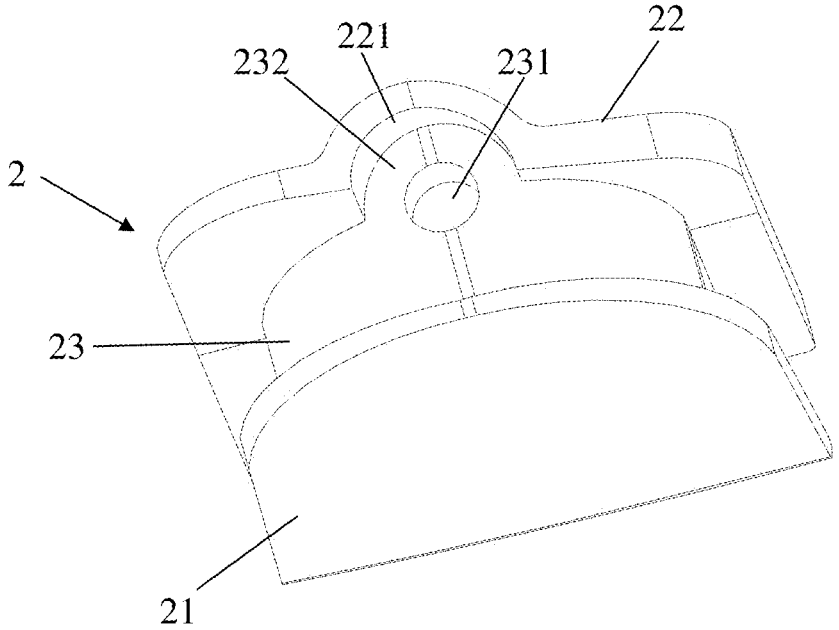
FIG. 7 shows a perspective view of the trim cover in a first perspective.
Figure 8:
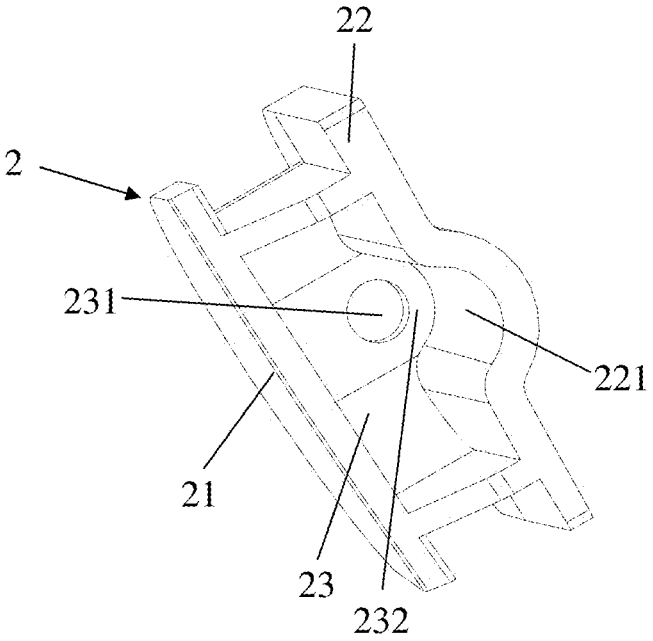
FIG. 8 shows a perspective view of the trim cover in a second perspective.

FIG. 4 shows an enlarged view of the trim cover installed in the pipeline through groove. FIG. 5 shows a schematic view of the trim cover when inserted into the pipeline through groove. FIG. 6 shows a perspective view of the pipeline through groove. FIG. 7 shows a perspective view of the trim cover in a first perspective. FIG. 8 shows a perspective view of the trim cover in a second perspective. In an embodiment, as shown in FIG. 4-FIG. 8, the trim cover 2 comprises an outer cover plate 21, an inner cover plate 22, and a cover connection plate 23 connected between the outer cover plate 21 and the inner cover plate 22.

A limit groove 122 is provided at a groove opening of the pipeline through groove 121.

The outer cover plate 21 is disposed in the limit groove 122, and the base side plate 12 is disposed between the outer cover plate 21 and the inner cover plate 22.

The cover connection plate 23 is connected to the base side plate 12 by a connecting member 3.

In this embodiment, the trim cover 2 comprises the outer cover plate 21, the inner cover plate 22, and the cover connection plate 23. The cover connection plate 23 is connected between the outer cover plate 21 and the inner cover plate 22.

The limit groove 122 is disposed at the groove opening on the outer side of the pipeline through groove 121. The size of the limit groove 122 is larger than the size of the groove opening of the pipeline through groove 121, so that a step portion is formed between the limit groove 122 and the pipeline through groove 121 for stopping the outer cover plate 21.

When the toilet cover base is assembled, the outer cover plate 21 is inserted into the limit groove 122, the inner cover plate 22 is lapped over (e.g., abuts, contacts) the inner side of the base side plate 12, the base side plate 12 is disposed between the outer cover plate 21 and the inner cover plate 22, and the cover connection plate 23 is connected to the base side plate 12 by the connecting member 3. The connecting member 3 can be selected from screws, bolts, etc. The step portion can stop the outer cover plate 21 from moving inwards, and the base side plate 12 can stop the inner cover plate 22 from moving outwards. Thus, the assembly stability of the trim cover 2 and the base side plate 12 may be improved.

In an embodiment, as shown in FIG. 4 and FIG. 6, a side plate boss 123 is provided on one side of the base side plate 12. The side plate boss 123 is around or adjacent to the pipeline through groove 121. The inner cover plate 22 is lapped over (e.g., abuts, contacts) the side plate boss 123.

The side plate boss 123 is formed integrally on the inside (e.g., an inner side) of the base side plate 12 and has a flat surface to facilitate lap connection with the inner cover plate 22 to stop the inner cover plate 22 from moving outwards.

In an embodiment, as shown in FIG. 4-FIG. 8, the pipeline through groove 121 is a U-shaped groove with a downward opening, and a top portion (e.g., a side plate mounting plate 125 as described below) of the pipeline through groove 121 has a connection hole 124.

The cover connection plate 23 is a U-shaped plate with a downward opening, and a top portion of the cover connection plate 23 has a connection plate through hole 231.

The cover connection plate 23 is disposed in the pipeline through groove 121, and the connecting member 3 passes through the connection plate through hole 231 and is connected to the connection hole 124 (e.g., the connecting member 3 passes through both of the connection plate through hole 231 and the connection hole 124).

In this embodiment, the pipeline through groove 121 is a U-shaped groove with a downward opening. The connection hole 124 is provided at the top portion of the pipeline through groove 121, and the connection hole 124 is disposed in the base side plate 12.

The cover connection plate 23 is a U-shaped plate with a downward opening. The connection plate through hole 231 is provided at the top portion of the cover connection plate 23.

When the toilet cover base is assembled, the cover connection plate 23 abuts the surface of the pipeline through groove 121, the connection plate through hole 231 is aligned with the connection hole 124, and the connecting member 3 passes through the connection plate through hole 231 and connected to the connection hole 124 to fixedly connect the cover connection plate 23 to the base side plate 12.

In an embodiment, as shown in FIG. 4-FIG. 8, the top portion of the pipeline through groove 121 has a side plate mounting plate 125 extending towards the side of the base body 11, and the connection hole 124 is provided on the side plate mounting plate 125.

The top portion of the cover connection plate 23 has a connection plate protrusion 232 protruding towards the side of the base body 11, and the connection plate through hole 231 is provided on the connection plate protrusion 232.

In this embodiment, the side plate mounting plate 125 is provided integrally on the inner side of the base side plate 12, and the side plate mounting plate 125 is disposed on the inner side of the top portion of the pipeline through groove 121, and the connection hole 124 is provided on the side plate mounting plate 125.

Correspondingly, the top portion of the cover connection plate 23 is provided integrally with the connection plate protrusion 232 protruding inwardly, and the connection plate through hole 231 is provided on the connection plate protrusion 232.

When the toilet cover base is assembled, the connection plate protrusion 232 abuts the side plate mounting plate 125, the connection plate through hole 231 is aligned with the connection holes 124, and the connecting member 3 passes through the connection plate through hole 231 and is connected to the connection holes 124. Thus, the space where the connecting member 3 is located is increased, and the screwing of the connecting member 3 by a tool is facilitates.

In an embodiment, as shown in FIG. 7 and FIG. 8, the inner cover plate 22 comprises a cover plate groove 221 disposed on a side, facing the connection plate protrusion 232, of the inner cover plate 22. The connection plate protrusion 232 is connected to the cover plate groove 221. The cover plate groove 221 extends from the top portion to a bottom portion of the inner cover plate 22 to increase a mounting space of the connecting member 3.

In an embodiment, the outer cover plate 21, the inner cover plate 22, and the cover connection plate 23 are formed integrally. The trim cover 2 is a plastic part, and the outer cover plate 21, the inner cover plate 22, and the cover connection plate 23 are molded in one piece. Thus, it is convenient for processing and molding, and the trim cover 2 has high structural strength.

In an embodiment, an outer surface of the outer cover plate 21 is flush (e.g., aligned) with an outer surface of the base side plate 12 to obtain a good decorative appearance.

According to FIG. 1, FIG. 2, FIG. 3, FIG. 9, and FIG. 10, according to an embodiment of the present disclosure, a toilet cover assembly comprises a toilet cover base 1 as described in any of the above discussed embodiments.

The toilet cover assembly comprises a toilet cover 4 and a toilet cover base 1.

For the structure, the construction, and the working principle of the toilet cover base 1, reference may be made to the above descriptions of the toilet cover base 1. Thus, the structure, the construction, and the working principle of the toilet cover base 1 are not described herein.

The toilet cover 4 comprises a seat cover 41 and a seat 42 below the seat cover 41, and the seat cover 41 and the seat 42 are connected to the base body 11 of the toilet cover base 1 by a pivot.

According to an embodiment of the present disclosure, a toilet bowl comprises the toilet cover assembly as described in the above embodiments.

The toilet comprises a ceramic body and a toilet cover assembly, and the toilet cover base 1 of the toilet cover assembly is fixedly installed in the rear part of the ceramic body.

In an embodiment, the toilet includes a base (e.g., a pedestal, bowl, etc.) and a tank. The base is configured to be attached to another object such as a drainpipe, floor, or another suitable object. The base includes a bowl, a sump (e.g., a receptacle) disposed below the bowl, and a trapway fluidly connecting the bowl to a drainpipe or sewage line. The tank may be supported by the base, such as an upper surface of a rim. The tank may be integrally formed with the base as a single unitary body. In other embodiments, the tank may be formed separately from the base and coupled (e.g., attached, secured, fastened, connected, etc.) to the base. The toilet may further include a tank lid covering an opening and inner cavity in the tank. The toilet may include a seat assembly including a seat and a seat cover rotatably coupled to the base. The toilet may further include a hinge assembly.

In another embodiment, the toilet may be a tankless toilet. The toilet includes a base and a seat assembly coupled to the base. The base includes a bowl, a sump disposed below the bowl, and a trapway fluidly connecting the bowl to a drainpipe or sewage line. The toilet includes a waterline that supplies the toilet with water. The toilet may further include a seat assembly including a seat and a seat cover rotatably coupled to the base. The toilets described above are provided herein as non-limiting examples of toilets that may be configured to utilize aspects of the present disclosure.

In some examples, a bidet may be included in a seat or pedestal of a toilet. In other examples, the bidet may be manufactured separately from and attached or coupled to a seat or pedestal of a toilet. The bidet includes a housing. The housing is configured to receive a flow of water through a housing inlet and dispense the flow of water from a housing outlet. The housing inlet and housing outlet may be located on opposite ends of the housing from one another, such that water may flow through the housing from the housing inlet to the housing outlet. In some examples, the housing further includes a chamber. As the housing receives the flow of water, the chamber may fill with water and provide a flow of water between the housing inlet and the housing outlet. The chamber may be configured to contain the flow of water and direct the flow of water from the housing inlet to the housing outlet. After the chamber has filled with water, the flow of water may travel along a substantially linear path between the housing inlet and the housing outlet. In some examples, one or more walls within the housing may be included to help direct a flow of water between the housing inlet and the housing outlet. The bidet may further include a housing inlet conduit configured to direct a flow of water to the housing inlet. The housing inlet conduit may be coupled to a water supply such as tank or waterline. The housing may further include a gear assembly or a portion of the gear assembly.

In summary, the present disclosure provides a toilet cover base, a toilet cover assembly, and a toilet, which can meet the non-concealed pipeline arrangement demand by removing the trim cover 2 and can meet the concealed pipeline arrangement demand by installing the trim cover 2. Thus, the user's pipeline arrangement demands may be met, and the scope of the present disclosure of the product may be expanded.

Figure 11:
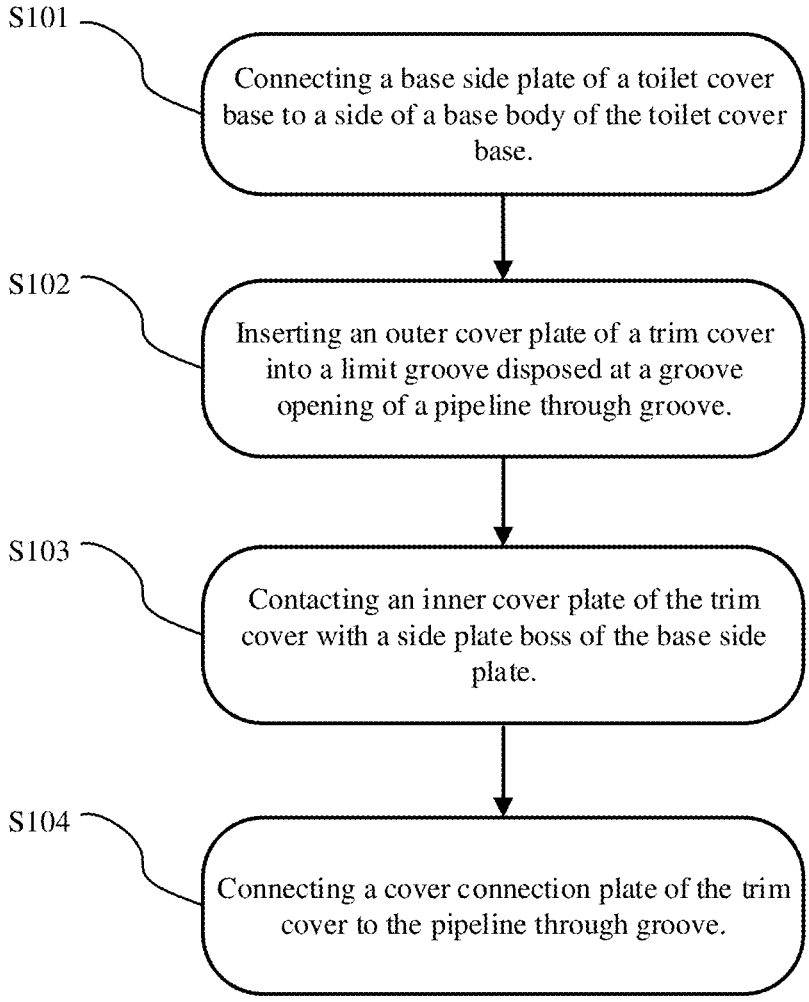
FIG. 11 is a flow chart of a method for assembling the toilet cover base according to an example of the present disclosure.

FIG. 11 is a flow chart of a method for assembling the toilet cover base according to an example of the present disclosure. The toilet cover base used in the method may be the spray pipe assembly according to any of the foregoing examples and may be configured to perform an operation, function, or the like as described in the present disclosure.

At act S101, a user may connect the base side plate 12 of the toilet cover base to a side of the base body 11 of the toilet cover base. The pipeline arrangement groove 111 is disposed in the base body 11, and the pipeline through groove 121 is disposed in the base side plate 12.

Specifically, as noted above, the pipeline arrangement groove 111 may be provided in a bottom of the base body 11, and the pipeline through groove 121 may be provided in the base side plate 12.

At act S102, the user may insert the outer cover plate 21 of the trim cover 2 into the limit groove 122 disposed at the groove opening of the pipeline through groove 121.

Specifically, as noted above, the outer cover plate 21 may be disposed in the limit groove 122. The size of the limit groove 122 is larger than the size of the groove opening of the pipeline through groove 121, so that the step portion is formed between the limit groove 122 and the pipeline through groove 121 for stopping the outer cover plate 21.

At act S103, the user may contact the inner cover plate 22 of the trim cover 2 with the side plate boss 123 of the base side plate 12.

Specifically, as noted above, the side plate boss 123 is provided on one side of the base side plate 12. The side plate boss 123 is around or adjacent to the pipeline through groove 121. The inner cover plate 22 is lapped over (e.g., abuts, contacts) the side plate boss 123.

At act S104, the user may connect the cover connection plate 23 of the trim cover 2 to the pipeline through groove 121.

Specifically, as noted above, when the toilet cover base is assembled, the cover connection plate 23 abuts the surface of the pipeline through groove 121, the connection plate through hole 231 is aligned with the connection hole 124, and the connecting member 3 passes through the connection plate through hole 231 and connected to the connection hole 124 to fixedly connect the cover connection plate 23 to the base side plate 12.

The above technical solutions may be combined as required to achieve the best technical effect.

The above are merely the principle and the embodiments of the present disclosure. It should be pointed out that, for those of ordinary skill in the art, other modifications may be made on the basis of the principle of the present disclosure, which should also be regarded as falling in the protection scope of the present disclosure.

I claim:

1. A toilet cover base, comprising:

a base body;

a base side plate connected to a side of the base body;

a pipeline arrangement groove disposed in the base body and configured to accommodate at least one pipeline;

a pipeline through groove disposed in the base side plate and adjacent to a side of the pipeline arrangement groove, the pipeline through groove configured to allow the at least one pipeline to pass through from an outside of the base side plate;

a trim cover removably installed in the pipeline through groove; and a limit groove disposed at a groove opening of the pipeline through groove, wherein the trim cover comprises:

an outer cover plate disposed in the limit groove;

an inner cover plate; and a cover connection plate connected between the outer cover plate and the inner cover plate, wherein the base side plate is disposed between the outer cover plate and the inner cover plate, and wherein the cover connection plate is connected to the base side plate by a connecting member.

2. The toilet cover base according to claim 1, wherein a step portion is formed between the limit groove and the pipeline through groove and is configured to stop the outer cover plate from moving inwards when the outer cover plate is inserted into the limit groove.

3. The toilet cover base according to claim 2, wherein the base side plate is configured to stop the inner cover plate from moving outwards.

4. The toilet cover base according to claim 3, further comprising:

a side plate boss disposed on an inner side of the base side plate, the side plate boss being adjacent to the pipeline through groove, wherein the inner cover plate abuts the side plate boss so that the inner cover plate is stopped from moving outwards.

5. The toilet cover base according to claim 4, wherein a top portion of the pipeline through groove comprises a connection hole, p1 wherein a top portion of the cover connection plate comprises a connection plate through hole, and wherein the cover connection plate is disposed in the pipeline through groove, and the connecting member passes through the connection plate through hole and the connection hole to connect the cover connection plate to the pipeline through groove.

6. The toilet cover base according to claim 5, wherein the pipeline through groove is a U-shaped groove comprises a downward opening, and wherein the cover connection plate is a U-shaped plate comprising a downward opening.

7. The toilet cover base according to claim 6, wherein the top portion of the pipeline through groove comprises a side plate mounting plate extending towards the base body, wherein the connection hole is disposed on the side plate mounting plate, wherein the top portion of the cover connection plate comprises a connection plate protrusion protruding towards the base body, and wherein the connection plate through hole is disposed on the connection plate protrusion.

8. The toilet cover base according to claim 7, wherein the inner cover plate comprises a cover plate groove disposed on a side, facing the connecting plate protrusion, of the inner cover plate, and wherein the connecting plate protrusion is connected to the cover plate groove.

9. The toilet cover base according to claim 1, wherein the outer cover plate, the inner cover plate, and the cover connection plate are integrally formed.

10. The toilet cover base according to claim 1, wherein an outer surface of the outer cover plate is aligned with an outer surface of the base side plate.

11. The toilet cover base according to claim 1, wherein the at least one pipeline comprises a water supply hose and a power cord.

12. A toilet cover assembly, comprising:

a toilet cover base, comprising:

a base body;

a base side plate connected to a side of the base body;

a pipeline arrangement groove disposed in the base body and configured to accommodate at least one pipeline;

a pipeline through groove disposed in the base side plate and adjacent to a side of the pipeline arrangement groove, the pipeline through groove configured to allow the at least one pipeline to pass through from an outside of the base side plate; and a trim cover removably installed in the pipeline through groove;

a toilet cover, comprising:

a seat cover connected to the base body of the toilet cover base; and a seat disposed below the seat cover connected to the base body of the toilet cover base; and a limit groove disposed at a groove opening of the pipeline through groove, wherein the trim cover comprises:

an outer cover plate disposed in the limit groove;

an inner cover plate; and a cover connection plate connected between the outer cover plate and the inner cover plate, wherein the base side plate is disposed between the outer cover plate and the inner cover plate, and wherein the cover connection plate is connected to the base side plate by a connecting member.

13. The toilet cover assembly according to claim 12, wherein a step portion is formed between the limit groove and the pipeline through groove and is configured to stop the outer cover plate from moving inwards when the outer cover plate is inserted into the limit groove.

14. A method for assembling a toilet cover base, the method comprising:

connecting a base side plate of the toilet cover base to a side of a base body of the toilet cover base, wherein a pipeline arrangement groove is disposed in the base body, and wherein a pipeline through groove is disposed in the base side plate;

placing the pipeline through groove adjacent to a side of the pipeline arrangement groove so as to allow at least one pipeline to pass through from an outside of the base side plate;

inserting an outer cover plate of a trim cover into a limit groove disposed at a groove opening of the pipeline through groove;

contacting an inner cover plate of the trim cover with a side plate boss of the base side plate; and connecting a cover connection plate of the trim cover to the pipeline through groove, wherein the connecting the cover connection plate of the trim cover to the pipeline through groove comprises:

contacting the cover connection plate with the pipeline through groove;

aligning a connection plate through hole of the cover connection plate with a connection hole of the pipeline through groove; and inserting a connecting member into the connection plate through hole and the connection hole.

15. The method according to claim 14, further comprising:

connecting a connection plate protrusion of the cover connection plate to a cover plate groove disposed on a side, facing the connection plate protrusion, of the inner cover plate.

16. The method according to claim 15, further comprising:

stopping, by the pipeline through groove, the outer cover plate from moving inwards when the outer cover plate is inserted into the limit groove.

17. The method according to claim 16, further comprising:

stopping the inner cover plate from moving outwards by contacting the inner cover plate with the side plate boss.

* * * * *